US011826777B2

(12) United States Patent
Park et al.

(10) Patent No.: US 11,826,777 B2
(45) Date of Patent: Nov. 28, 2023

(54) VIBRATION-BASED COATING LAYER SURFACE MODIFICATION METHOD CONSIDERING BOUNDARY LAYER THICKNESS

(71) Applicant: GACHON UNIVERSITY OF INDUSTRY—ACADEMIC COOPERATION FOUNDATION, Seongnam-si (KR)

(72) Inventors: Kyoung Su Park, Seoul (KR); Dong Su Park, Seoul (KR)

(73) Assignee: GACHON UNIVERSITY OF INDUSTRY—ACADEMIC COOPERATION FOUNDATION, Seongnam-si (KR)

( * ) Notice: Subject to any disclaimer, the term of this patent is extended or adjusted under 35 U.S.C. 154(b) by 0 days.

(21) Appl. No.: 17/574,038

(22) Filed: Jan. 12, 2022

(65) Prior Publication Data

US 2022/0219196 A1 Jul. 14, 2022

(30) Foreign Application Priority Data

Jan. 13, 2021 (KR) ..... 10-2021-0004616

(51) Int. Cl.
*B05D 3/12* (2006.01)
*B05D 5/02* (2006.01)

(52) U.S. Cl.
CPC ..... *B05D 3/12* (2013.01); *B05D 5/02* (2013.01)

(58) Field of Classification Search
CPC ..... B05D 3/12
USPC ..... 427/346
See application file for complete search history.

(56) References Cited

U.S. PATENT DOCUMENTS 5,262,193 A * 11/1993 Louks ..... B05C 9/08 427/299
2006/0068089 A1* 3/2006 Brosemer ..... B05D 3/12 427/372.2

FOREIGN PATENT DOCUMENTS

JP 11-323573 A 11/1999
JP 2018-193596 A 12/2018

OTHER PUBLICATIONS

Eslamian, M. Excitation by acoustic vibration as an effective tool for improving the characteristics of the solution-processed coatings and thin films. Progress in Organic Coatings 113 (2017) 60-73. (Year: 2017).*

(Continued)

*Primary Examiner* — William P Fletcher, III
(74) *Attorney, Agent, or Firm* — Sughrue Mion, PLLC

(57) ABSTRACT

A method of modifying the surface of a coating layer applied to a substrate includes a step (s1) of preparing a substrate by performing pretreatment, a step (s2) of coating the substrate with a coating layer, and a step (s3) of modifying the surface of the coating layer by vibrating the substrate in the vertical direction. The surface modification method does not include a separate chemical process.

10 Claims, 10 Drawing Sheets

(56) References Cited

OTHER PUBLICATIONS

Dong-Su Park et al., "Surface wettability of thin liquid films using vertical ultrasonic vibration-assisted coating technology", Results in Physics, 2021. pp. 1-10, vol. 30, No. 104828.
Dong-Su Park et al., "Optimal functional surface coating considering internal flow behavior of viscous-liquids driven by vertical ultrasonic waves", Results in Physics, 2021, pp. 1-14, vol. 25, No. 104255.
Dong-Su Park et al., "Vibration-based surface treatment considering viscous penetration length" Microsystem Technologies, 2020, pp. 1-11.

* cited by examiner

VIBRATION-BASED COATING LAYER SURFACE MODIFICATION METHOD CONSIDERING BOUNDARY LAYER THICKNESS

CROSS REFERENCE TO RELATED APPLICATIONS

This application claims benefit of and priority to Korean Patent Application No. 10-2021-0004616 filed Jan. 13, 2021, the content of which is incorporated by reference in its entirety.

BACKGROUND

Field

The invention of this application relates to a technology for treating the surface of a coating film and relates to a surface modification method for imparting functionality to the surface of a coating layer by vertically vibrating a substrate coated with the coating layer and controlling the surface roughness and surface width of the coating layer in order to control the surface wettability of the coating layer.

Description of the Related Art

In general, surface coating is used in various industrial fields such as aviation and shipbuilding industries, semiconductors, solar panels, and radars. Surface coating is mainly used for the purpose of preventing corrosion and condensation on the surface caused by changes in humidity and temperature. However, in recent years, such a coating technology has been applied to change the properties of surface in addition to these properties. Among the properties of surface, wettability is typical. This is to have a hydrophobic or hydrophilic property depending on the surface tension, and changing such properties by the coating technology have recently been attempted.

A number of studies have been conducted to control the wettability of the coated surface. In order to implement a wettability-controlled surface, a method has been used in which the surface energy of the coating layer is changed by forming a microstructure on the surface of a solid through MEMS/NEMS process and the like or the surface energy of the coating layer is changed by coating the surface with another material.

In particular, various methods for forming a functional surface by forming a microstructure on the surface of the coating layer have been studied. However, in order to form a functional surface through the conventional microstructure forming process, high cost, complicated process, safety and the like have been great problems to be solved.

CITATION LIST

Non-Patent Literature

Non-Patent Literature 1: Vibration-based surface treatment considering viscous penetration length (Nov. 1, 2020)

SUMMARY

An object of the present invention is to provide a method of modifying the surface of a coating layer with a low cost and a simple process. In addition, an object of the present invention is to provide a surface modification method, which is environmentally friendly since chemicals are not used in the method and is capable of modifying a surface having a larger area than before by utilizing vibration and controlling the functionality including hydrophilicity or hydrophobicity of a surface by providing optimal energy depending on the thickness and material properties of a coating layer.

The present invention is to achieve the objects stated above. According to an embodiment of the present invention, the surface modification method according to the present invention may comprise a step (s1) of preparing a substrate by performing pretreatment, a step (s2) of coating the substrate with a coating layer, and a step (s3) of modifying the surface of the coating layer by vibrating the substrate at a high frequency in a vertical direction for a long time.

In the step of modifying the surface, the surface roughness and surface width of the coating layer are controlled by vibrating the substrate, and through this, the surface wettability of the coating layer can be controlled.

DETAILED DESCRIPTION OF THE PREFERRED EMBODIMENTS

Figure 1:
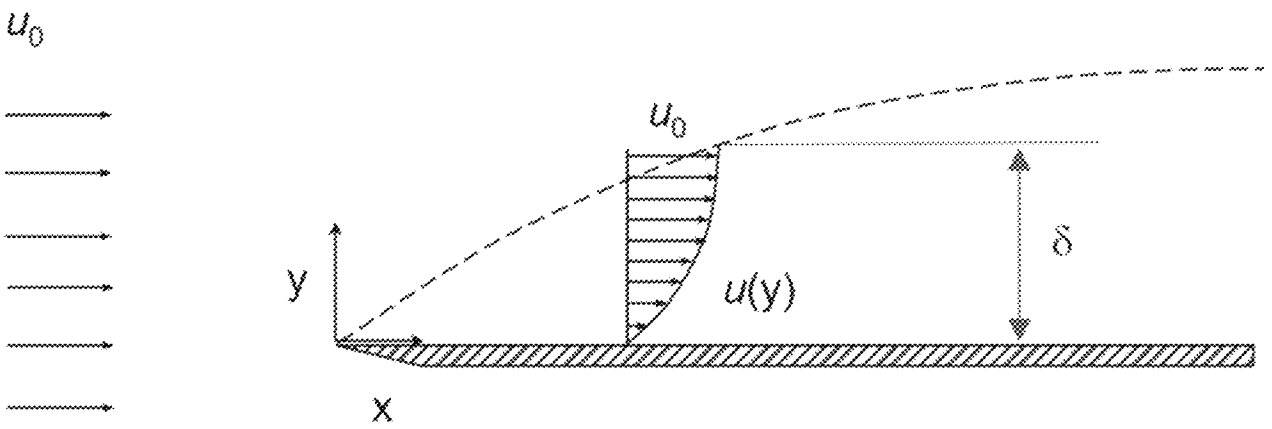
FIG. 1 is a diagram illustrating a velocity gradient of a fluid in a fluid.

Specific structural or functional descriptions for embodiments according to the concept of the present invention disclosed in the present specification or application are merely exemplified for the purpose of explaining the embodiments according to the concept of the present invention, and embodiments according to the concept of the present invention may be implemented in various forms and should not be construed as being limited to the embodiments described in the present specification or application.

Since the embodiments according to the concept of the present invention may have various changes and may have various forms, specific embodiments are illustrated in the drawings and are intended to be described in detail in the present specification or application. However, this is not intended to limit the embodiments according to the concept of the present invention to a specific disclosed form, and it should be understood to include all changes, equivalents or substitutes included in the spirit and scope of the present invention.

Unless defined otherwise, all terms used herein, including technical or scientific terms, have the same meanings as commonly understood by those of ordinary skill in the art to which the present invention pertains. Terms such as those defined in commonly used dictionaries should be interpreted as having meanings consistent with the meanings in the context of the related art and should not be interpreted in ideal or excessively formal meanings unless explicitly defined in the present specification.

In describing the embodiments, descriptions of technical contents that are well known in the technical field to which the present invention pertains and are not directly related to the present invention will be omitted. This is to more clearly convey the gist of the present invention without obscurity by omitting unnecessary descriptions.

Terms such as "on" or "above" and "below" or "under" may be understood to describe the relative positional relation between components or members, and terms "located above" or "located below" may be understood to represent a relative positional relation in a state in which it is not in contact with a specific object as well as in a state in which it is in contact with a specific object.

In the present specification, in a case where it is described that an arbitrary component or member is "connected" with another component or member, it may be understood that the case includes not only a case of being directly connected to another component or member but also a case of being connected to another component or member with a still another component or member interposed therebetween unless otherwise stated.

Similarly, it may be understood that the term "being in contact" may also include a case of being in direct contact as well as a case of being in contact with another component or member interposed therebetween.

When a component is "included", it means that other components may be further included unless otherwise stated.

In the present specification, the term "boundary layer" is a section in which a velocity gradient of a fluid develops in a fluid and refers to the thickness up to a position having a velocity of 99% of the full development velocity. FIG. 1 illustrates the velocity gradient of a fluid in a fluid.

In the present specification, the "viscous boundary layer ($\beta^{-1}$)" is the thickness near the boundary and refers to the point where the viscosity has the greatest effect. The viscous boundary layer ($\beta^{-1}$) is defined by the following equation. The velocity of the fluid gradually increases within the viscous boundary layer ($\beta^{-1}$), the velocity and pressure gradients are not sufficiently achieved, and thus microstreaming is generated rather than acoustic waves when vibration energy is transmitted to a coating layer.

$$\beta^{-1} = \sqrt{\frac{2\mu}{2\pi\rho f}}$$

In the equation, $\beta^{-1}$ means the viscous boundary layer, $\mu$ means the viscosity of the fluid, $\rho$ means the density of the fluid, and f means the vibration frequency.

The present invention relates to a surface modification method for modifying the surface of a coating layer formed on a substrate and thus imparting functionality to the surface, more specifically relates to a modification method in which vibrations are applied to a substrate in the vertical direction to change the surface roughness and surface width of a coating layer and the surface of the coating layer has hydrophobic or hydrophilic properties through this.

In addition, the present invention relates to a vibration-based method of modifying the surface of a coating layer, in which the optimum thickness of the coating layer is determined in consideration of the flow characteristics of the coating layer and viscous boundary layer and the optimum vibration frequency and voltage for performing processing so that the surface of the coating layer has the desired wettability are found and applied.

In other words, the object of the prior art has been to make the surface layer of a substrate flat and uniform by applying low-frequency vibrations to the substrate for a short time so that the coating solutions are well mixed. However, the object of the present invention is to increase the surface roughness of a coating layer and change the roughness and width of the coating layer by applying vibrations to the applied coating solution for a long time using a high frequency band, and thus to control the wettability of the coating layer. In other words, the present invention relates to a method of controlling the surface wettability of a coating layer by applying vibrations to the substrate while the coating solution is cured.

Hereinafter, the present invention will be described in detail by describing preferred embodiments of the present invention with reference to the accompanying drawings.

Figure 2:
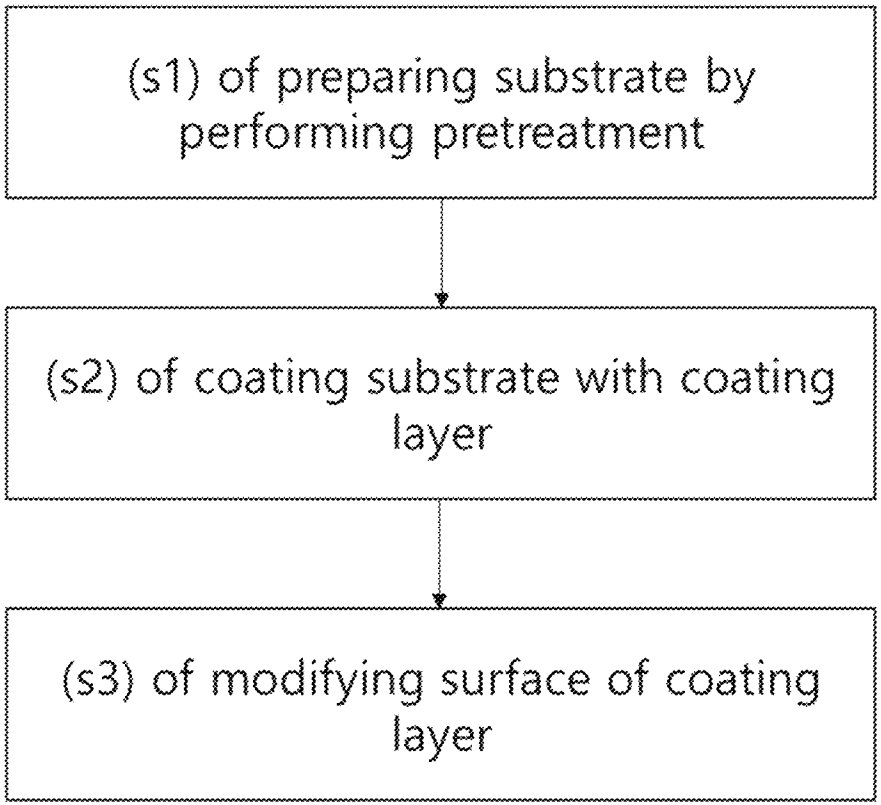
FIG. 2 is a flowchart of a modification method according to the present invention.

FIG. 2 is a flowchart of a modification method according to the present invention.

Referring to FIG. 2, the method of modifying the surface of a coating layer according to the present invention may comprise a step (s1) of preparing a substrate by performing pretreatment, a step (s2) of coating the substrate with a coating layer, and a step (s3) of modifying the surface of the coating layer.

The step (s1) of preparing a substrate by performing pretreatment refers to a step of preparing and cleaning a substrate having a desired size. More specifically, the substrate may be immersed in a solution in which ethanol and alcohol are mixed at a volume ratio of 1:1 and then be subjected to ultrasonic cleaning. However, since the cleaning of the substrate can be performed using various conventionally known solutions and methods, the detailed description thereof will be omitted.

The step (s2) of coating the substrate with a coating layer refers to coating the pretreated substrate with a coating layer.

The coating layer is formed by coating the substrate with a liquid solution. Such coating may be generally performed by well-known coating and deposition methods. In other words, the coating may be performed by various methods including an electrochemical method, a method using a nano colloidal solution, atomic layer deposition, dip coating, spin coating, and spraying. In other words, since conventionally known liquid solution coating and deposition methods are all applicable, detailed description thereof will be omitted.

According to an exemplary embodiment, the substrate may be coated with a coating layer by a dip coating method. According to a more specific embodiment, the substrate may be coated with a coating layer by a method in which the pretreated substrate is immersed in a mixed solution of polydimethylsiloxane (PDMS) and hexane.

Figure 3:
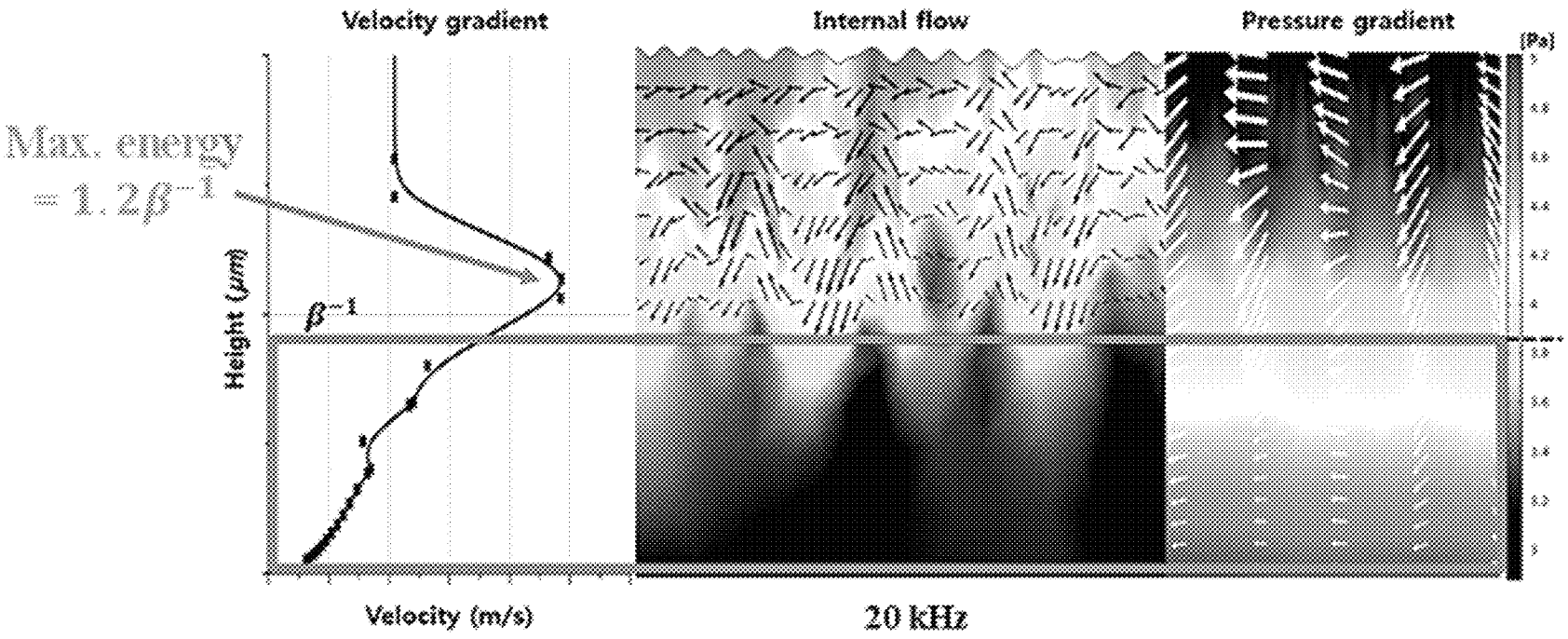
FIG. 3 is a diagram illustrating the relation between a thickness and an internal flow velocity of a coating layer.

If necessary, the step (s2) of coating with coating layer may include calculating an appropriate thickness of the coating layer. FIG. 3 is a diagram illustrating the relation between the thickness and internal flow velocity of the coating layer. According to FIG. 3, it can be seen that the thickness of the coating layer and the flow velocity inside the coating layer have a certain relation. In particular, it has been confirmed through experiments that there is a certain relation between the thickness (hereinafter, $Y_{vel\ max}$) at which the fluid in the coating layer has the maximum flow velocity and the viscous boundary layer ($\beta^{-1}$), and the relation equation is as follows.

$$Y_{velmax} = \frac{6}{5}\beta^{-1}$$

In other words, the thickness of the coating layer having the maximum flow velocity increases as the viscous boundary layer increases. Accordingly, it is possible to calculate the thickness of the coating layer having the optimal roughness by considering the components (viscosity and density of the solution) of the coating layer that determine the viscous boundary layer ($\beta^{-1}$), and the frequency. In other words, in the step (s2) of coating with coating layer, it is possible to apply the coating layer to have an appropriate thickness according to the value calculated by the equation.

When the thickness of the coating layer applied to the substrate is first determined, the frequency having the highest energy may be calculated and applied depending on the components (viscosity and density of the solution) of the coating layer.

The step (s3) of modifying the surface of the coating layer refers to modifying the surface of the coating layer by vibrating the substrate coated with the coating layer in the vertical direction. Unlike the prior art, in the present invention, the surface roughness and surface width of the coating layer are changed through vibration. The coating layer having a roughness increased by the modification method of the present invention exhibits a hydrophobic or hydrophilic function.

If necessary, the step (s3) of modifying the surface of the coating layer may include calculating the frequency and/or input voltage applied to the substrate depending on the required surface wettability.

Figure 4:
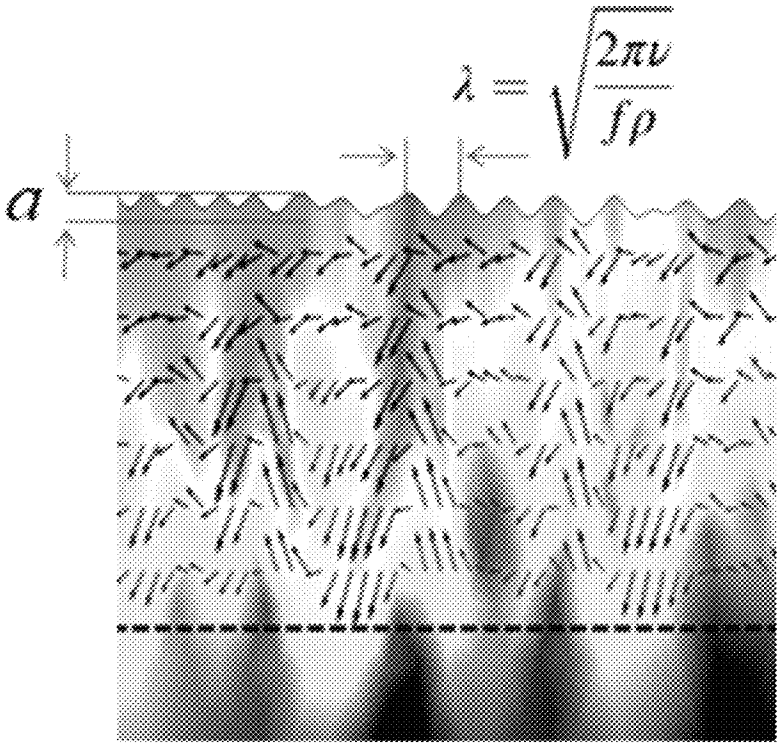
FIG. 4 is a diagram illustrating the internal flow and surface of a coating layer.

Hereinafter, a method of designing targeted surface modification characteristics will be more specifically described. FIG. 4 is a diagram illustrating the internal flow and surface roughness of the coating layer and the wavelength. Referring to FIG. 4, a is the surface roughness, represents the surface roughness of the substrate, and is a value corresponding to the amplitude, and λ is the wavelength and means the surface width.

At this time, a has a certain relation with the applied frequency, and the corresponding function is as follows.

$$a = \sqrt[3]{\frac{f_0}{f}}\sqrt{V_{max}(f)} = \sqrt[4]{\frac{A_I}{A_0}}\left(\frac{f_0}{f}\right)^{\frac{5}{24}}$$

In the equation, f is the frequency applied to the substrate, and $f_0$ is the standard frequency and means 20 kHz in the present embodiment. $V_{max}(f)$ means the velocity ($m/s^2$) of the internal flow of the fluid. $A_I$ is the input voltage corresponding to the vibration amplitude of the substrate, and $A_0$ is the basic voltage and means 50 V (about 20 nm @ 20 kHz, 0.001 Pa·s).

Accordingly, the relation equation for the roughness factor (r) that affects the surface roughness is as follows.

$$r = \frac{\cos\theta}{\cos\theta_Y} = 1 + \frac{(ka)^2}{4} = 1 + \frac{\pi^2}{\lambda^2}\sqrt{\frac{A_I}{A_0}}\left(\frac{f_0}{f}\right)^{\frac{5}{12}}$$

An equation that can control the surface wettability has been derived from the determined roughness factor.

$$\cos\theta = r\cos\theta_Y = \left(1 + \frac{\pi^2}{\lambda^2}\sqrt{\frac{A_I}{A_0}}\left(\frac{f_0}{f}\right)^{\frac{5}{12}}\right)\cos\theta_Y$$

Figure 5:
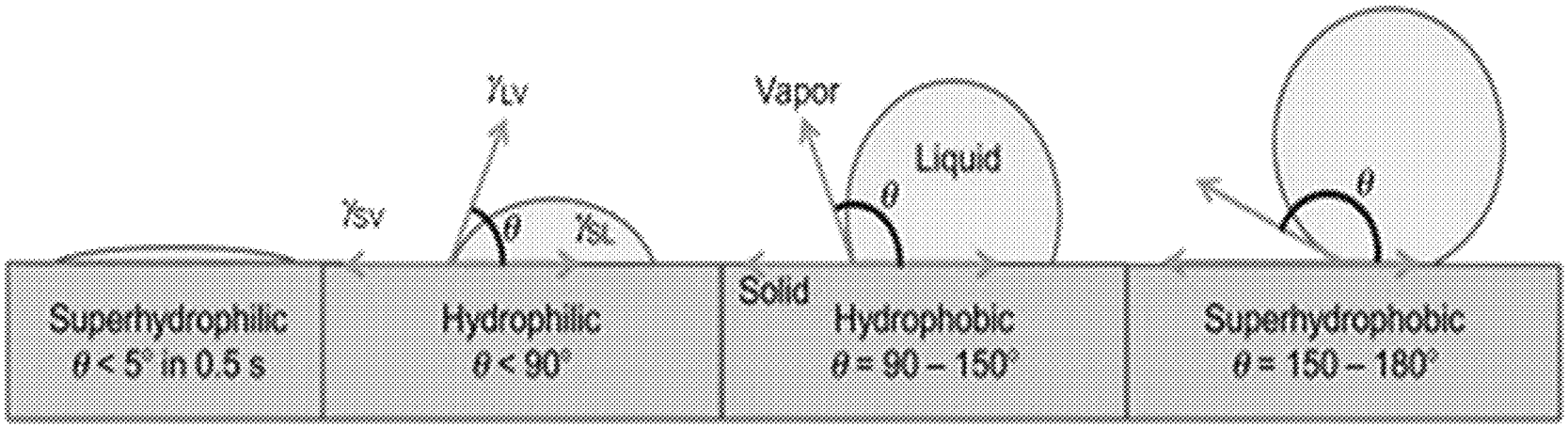
FIG. 5 is a diagram illustrating the wettability of a surface.

In the equation, k represents the wave number, a represents the surface roughness, θ represents the contact angle, which is a numerical value related to the surface wettability of the substrate, and the relation between the θ value and the surface properties is illustrated in FIG. 5. $\theta_Y$ corresponds to Young's contact angle. The wave number may be determined by using the theory according to the following equation.

$$k = \frac{2\pi}{\lambda}$$

According to the equation, the roughness factor value according to the required surface wettability may be determined, and then the required frequency and input voltage may be calculated. The surface wettability of the substrate may be controlled through the process of vibrating the substrate according to the calculated frequency and input voltage.

In the modification step according to the present invention, the frequency of vibration applied to the substrate is 20 kHz or more and less than 1 MHz. In other words, by applying vibrations in the frequency region of 20 kHz or more and less than 1 MHz using a piezo actuator, the surface roughness of the coating layer may be changed and thus the surface may be modified. If necessary, the frequency of vibration applied to the substrate may be 15 kHz or higher, 20 kHz or higher, 25 kHz or higher, 30 kHz or higher, 35 kHz or higher, 40 kHz or higher, 45 kHz or higher, 50 kHz or higher, 55 kHz or higher, 60 kHz or higher, 65 kHz or higher, 70 kHz or higher, 75 kHz or higher, 80 kHz or higher, 85 kHz or higher, or 90 kHz or higher. If necessary, the frequency of vibration applied to the substrate may be 15 kHz or lower, 20 kHz or lower, 25 kHz or lower, 30 kHz or lower, 35 kHz or lower, 40 kHz or lower, 45 kHz or lower, 50 kHz or lower, 55 kHz or lower, 60 kHz or lower, 65 kHz or lower, 70 kHz or lower, 75 kHz or lower, 80 kHz or lower, 85 kHz or lower, or 90 kHz or lower.

If necessary, the step (s3) of modifying may be continuously performed for a predetermined time. For example, the step (s3) of modifying may be continuously performed for several minutes to several tens of minutes or several minutes to several hundreds of minutes.

If necessary, the step (s3) of modifying may be continuously performed until to have the a and λ values calculated according to the wettability of the formed coating layer. The wettability of the coating layer changes depending on the a and λ values on the surface of the coating layer. The surface wettability of the coating layer may be controlled by continuously applying vibrations to the coating layer until to have the a and λ values suitable for the coating layer to be formed.

Figure 8:
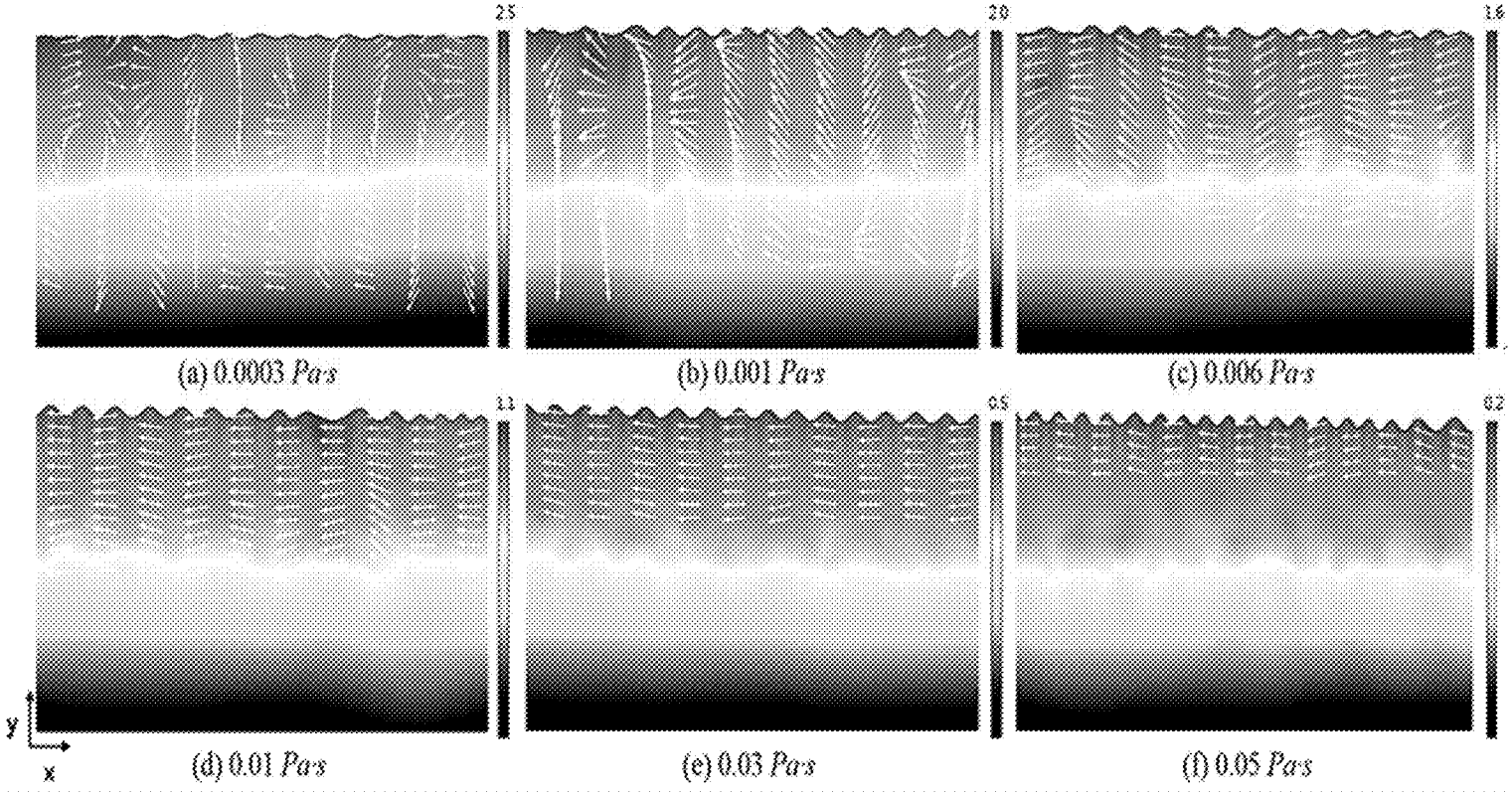
FIG. 8 is a diagram simulating the internal flow characteristics depending on the change in viscosity of a coating layer through simulations.

If necessary, the step (s3) of modifying may be continuously performed until the vertical movement of the fluid of the coating layer disappears. As can be seen in FIG. 8, the viscosity of the fluid gradually increases as the fluid of the coating layer is cured, and the vertical movement of the fluid disappears in this process. In the present invention, the surface wettability of the coating layer may be controlled by continuously applying vibrations to the coating layer until the vertical movement of the fluid disappears.

When the thickness of the coating layer is thinner than $\beta^{-1}$, the wave does not penetrate the coating layer and the flow inside the coating layer does not occur, and thus the thickness of the coating layer is required to be thicker than $\beta^{-1}$ in order to generate flow inside the coating layer.

If necessary, a step (s4) of curing the coating layer may be further included after the step (s3) of modifying the surface of the coating layer. As the method of curing the coating layer, there are various methods such as a method in which the coating layer is dried at room temperature and a method in which the coating layer is cured by applying heat to the coating layer. In general, a method of curing a liquid solution is applicable, and thus the detailed description thereof will be omitted.

Figure 6:
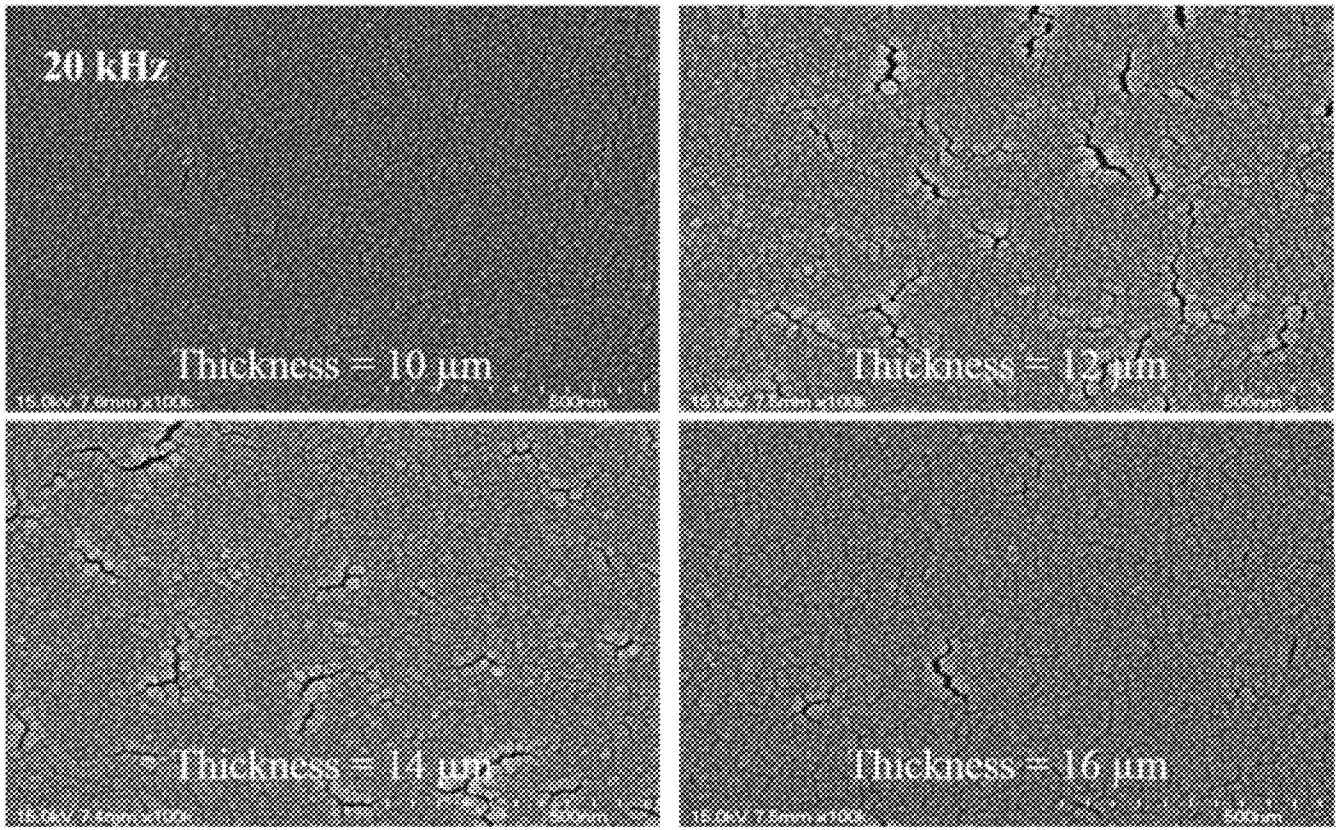
FIGS. 6 and 7 are diagrams for observing the change in surface roughness depending on the change in thickness of a coating layer at a certain frequency.
Figure 7:
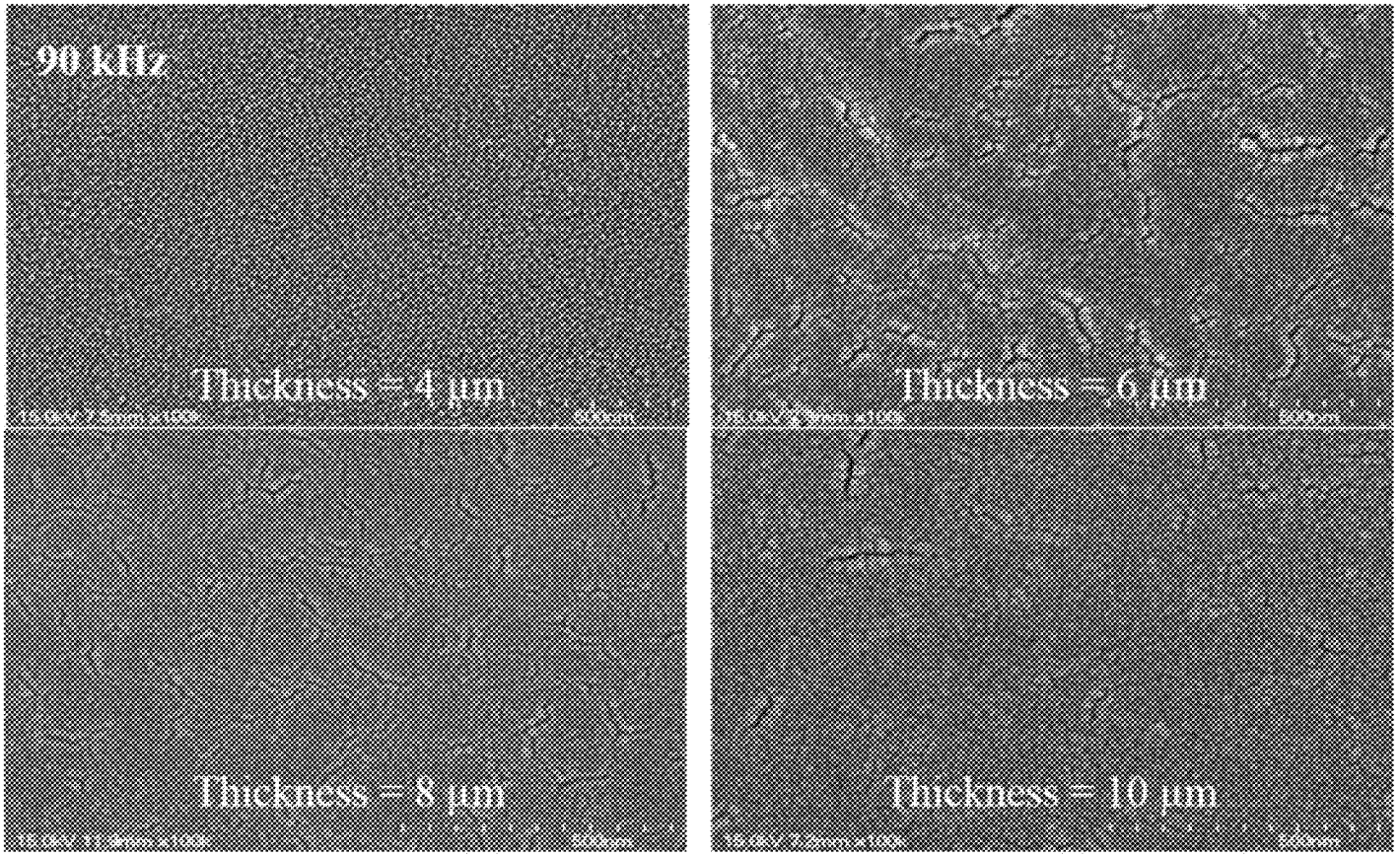

FIGS. 6 and 7 are diagrams for observing the change in surface roughness depending on the change in thickness of the coating layer at a certain frequency. According to FIG. 6, it shows that at a frequency of 20 kHz, the surface roughness of the coating layer is not changed significantly by vibration when the thickness of the coating layer is 10 μm but the surface roughness of the coating layer increases significantly as the thickness of the coating layer increases to 12 μm and 14 μm. FIG. 7 shows that in the case of conducting the same experiment at a frequency of 90 kHz, the surface roughness of the coating layer is not changed significantly by vibration when the thickness of the coating layer is 4 μm but the surface roughness of the coating layer increases significantly as the thickness of the coating layer increases to 6 μm. In other words, a coating layer having a high roughness may be formed by applying the coating layer to have an appropriate thickness according to the properties (density and viscosity) of the coating solution and the frequency.

FIG. 8 is a diagram simulating the internal flow characteristics as the coating layer is cured (viscosity increases) through simulations. All films have the same thickness (20 μm) and width (20 mm) and have different viscosities, and the values in each case are as those presented at the bottom of the drawing. The drawing shows how the flow inside the coating layer changes as the coating layer is cured, and it can be seen that the vertical movement force inside the coating layer decreases as the coating layer is cured (as the viscosity increases). According to the simulations, it can be seen that the fluid receives the greatest force in the vertical direction when having a viscosity of 0.003 Pa·s and the flow characteristics in the vertical direction are not observed when the viscosity is 0.03 Pa·s or more. If necessary, in the present invention, the surface modifying step of continuously applying vibrations to the substrate may be performed until the fluid does not move in the vertical direction (until the fluid is cured to a certain level).

Figure 9:
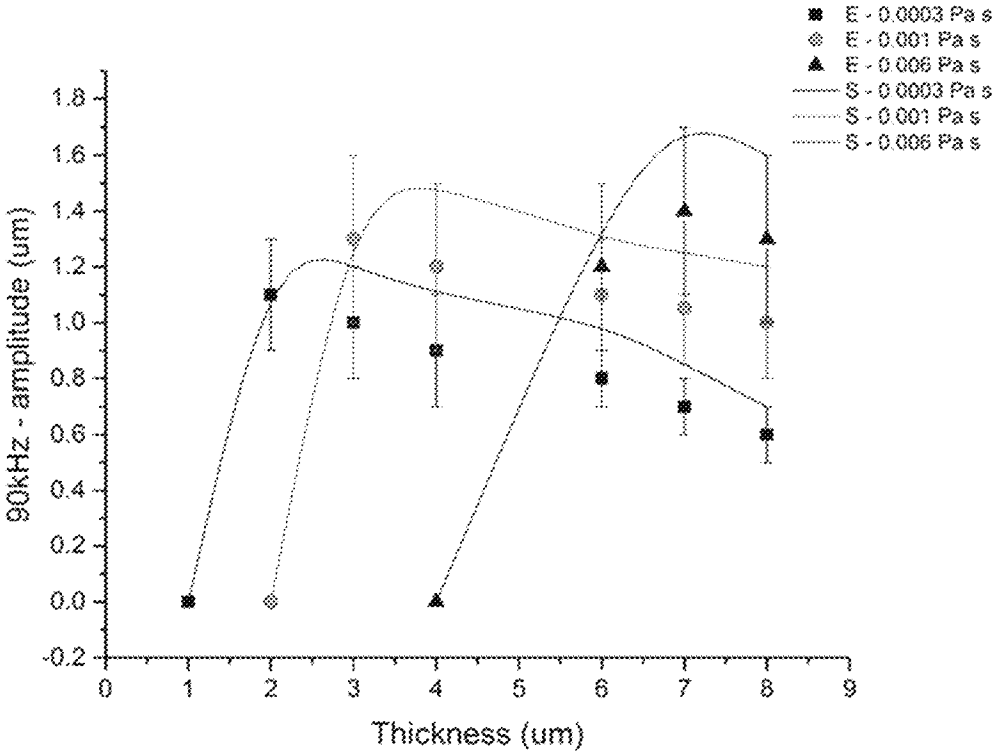
FIG. 9 is a diagram illustrating the relation between the thickness and surface roughness of a coating layer at a certain frequency measured through experiments and simulations.

FIG. 9 is a diagram illustrating the relation between the thickness and surface roughness of the coating layer at a certain frequency measured through experiments and simulations. Referring to FIG. 9, it shows that the thickness of the coating layer and the surface roughness of the coating layer have a certain relation, the surface roughness increases as the thickness increases until the thickness increases from 0 to a certain level and the surface roughness of the coating layer decreases as the thickness increases after the surface roughness reaches the maximum value.

Figure 10:
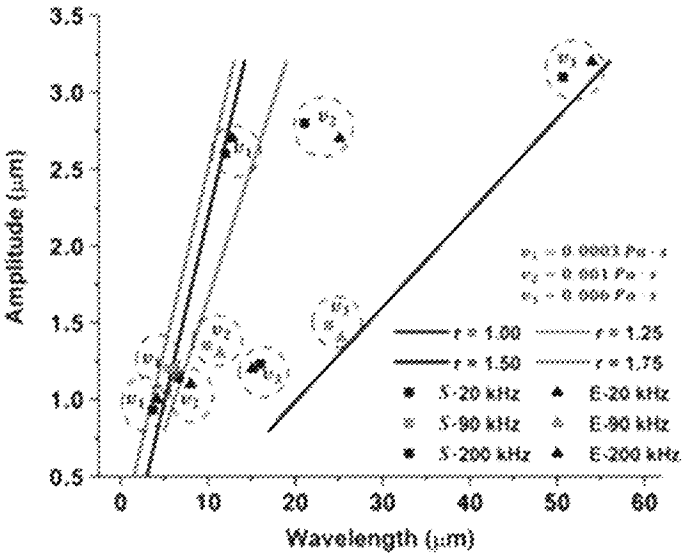
FIG. 10 is a diagram illustrating simulation values ($r_s$) and experimental values ($r_E$) of surface roughness.

FIG. 10 is a diagram illustrating simulation values ($r_s$) and experimental values ($r_E$) of surface roughness. Referring to FIG. 10, the surface roughness coefficient decreases linearly as the viscosity increases when the frequency is kept constant. In addition, the influence of amplitude and wavelength on the surface roughness coefficient decreases as the viscosity increases. This is because as the viscosity is higher, the attenuation of the input vibration is more affected and the impedance mismatching may be larger. When comparing the graphs, it can be seen that the two results (theory and experiment) well match each other in the amplitude, wavelength, and surface roughness. In summary, as the frequency is higher and the viscosity is lower, the capillary wave due to the internal flow becomes larger and the surface roughness becomes larger. As the frequency changes, the impedance matching changes and the vibration energy transmitted to the film changes, and thus the error also varies depending on the frequency.

The present invention relates to a surface modification method for changing the surface roughness of a coating layer by vibrating a substrate coated with the coating layer in the vertical direction and thus imparting functionality (hydrophilicity or hydrophobicity) to the coating layer. In the surface modification method, the substrate is vibrated at a high frequency of 20 kHz or more and less than 1 MHz. In other words, the flow inside the coating layer may be generated by vibrating the substrate at a high frequency of 20 kHz or more, and the surface roughness may be increased by forming a capillary wave on the surface due to the internal flow.

In addition, the relation between the frequency and the thickness of the coating layer is derived, and an optimized thickness of the coating layer is derived through this.

The surface modification method according to the present invention is capable of modifying the surface of a coating layer without separate equipment or chemical reactions and thus is environmentally friendly and economically advantageous.

The surface modification method according to the present invention is for modifying the surface of a coating layer and imparting functionality to the surface, and is more specifically capable of changing the surface roughness and surface width of a coating layer by vertically applying high-frequency vibrations to a substrate coated with the coating layer for a long time and thus of manufacturing a substrate exhibiting desired wettability (hydrophobicity or hydrophilicity).

Moreover, the surface modification method is capable of modifying the surface of a coating layer through high-frequency vibration without separate equipment or chemical reactions and thus is environmentally friendly and economically advantageous.

While the present invention has been described with respect to the specific embodiments, it will be apparent to those skilled in the art that various changes and modifications may be made without departing from the spirit and scope of the invention as defined in the following claims.

What is claimed is:

1. A vibration-based method of modifying a surface of a coating layer, the method comprising:

a step (s1) of preparing a substrate by performing pretreatment;

a step (s2) of coating the substrate with a coating layer; and a step (s3) of modifying a surface of the coating layer by vibrating the substrate in a vertical direction, wherein a thickness of the coating layer has the same value as a thickness ($Y_{vel\ max}$) having a maximum flow velocity determined by the following equation:

$$Y_{velmax} = \frac{6}{5}\beta^{-1}$$

where $Y_{vel\ max}$ means a thickness at which a fluid in the coating layer has a maximum flow velocity and $\beta^{-1}$ is a viscous boundary layer.

2. The vibration-based method of modifying a surface of a coating layer according to claim 1, wherein a surface roughness and a surface width of the coating layer are changed by vibrating the substrate in the step (s3) of modifying the surface.

3. The vibration-based method of modifying a surface of a coating layer according to claim 2, wherein the step (s3) of modifying includes determining a suitable frequency depending on a thickness of the coating layer.

4. The vibration-based method of modifying a surface of a coating layer according to claim 1, wherein a frequency of vibration applied to the substrate is 20 kHz or more and less than 1 MHz in the step (s3) of modifying.

5. The vibration-based method of modifying a surface of a coating layer according to claim 4, wherein the step (s3) of modifying is continuously performed until a and λ values calculated depending on wettability of the coating layer are achieved, wherein a is the surface roughness amplitude, and λ is the surface roughness wavelength.

6. The vibration-based method of modifying a surface of a coating layer according to claim 4, wherein the step (s3) of modifying is continuously performed until vertical movement of a fluid of the coating layer disappears.

7. The vibration-based method of modifying a surface of a coating layer according to claim 1, wherein the $\beta^{-1}$ (viscous boundary layer) is determined by the following equation:

$$\beta^{-1} = \sqrt{\frac{2\mu}{2\pi\rho f}}$$

where μ is a viscosity of a fluid, ρ is a density of a fluid, and f is a vibration frequency.

8. The vibration-based method of modifying a surface of a coating layer according to claim 1, wherein the step (s3) of modifying a surface of the coating layer includes a step of calculating a frequency and a voltage applied to the substrate depending on a required surface roughness.

9. The vibration-based method of modifying a surface of a coating layer according to claim 8, wherein the frequency is determined by the following equation:

$$r = \frac{\cos\theta}{\cos\theta_Y} = 1 + \frac{(ka)^2}{4} = 1 + \frac{\pi^2}{\lambda^2}\sqrt{\frac{A_I}{A_0}}\left(\frac{f_0}{f}\right)^{\frac{5}{12}}$$

in the step of calculating a frequency and an input voltage, wherein k is wave number, a is the surface roughness amplitude, θ is contact angle, $\theta_Y$ is Young's contact angle, λ is the surface roughness wavelength, f is a frequency applied to the substrate, $f_0$ is a standard frequency, $A_I$ is an input voltage corresponding to a vibration amplitude of the substrate, and $A_0$ is a basic voltage.

10. A vibration-based method of modifying a surface of a coating layer, the method comprising:

a step (s1) of preparing a substrate by performing pretreatment;

a step (s2) of coating the substrate with a coating layer; and a step (s3) of modifying a surface of the coating layer by vibrating the substrate in a vertical direction, wherein a surface roughness and a surface width of the coating layer are changed by vibrating the substrate in the step (s3) of modifying the surface, and wherein the surface roughness of the coating layer increases and the coating layer having the increased surface roughness exhibits a hydrophobic or hydrophilic function.

* * * * *